US007717738B2

(12) United States Patent
Mabry

(10) Patent No.: US 7,717,738 B2
(45) Date of Patent: May 18, 2010

(54) POWER CORD MANAGEMENT ATTACHMENT FOR USE WITH A POWER SOCKET DEVICE

(75) Inventor: John Dan Mabry, Seattle, WA (US)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 11/664,577

(22) PCT Filed: Mar. 8, 2005

(86) PCT No.: PCT/US2005/007490

§ 371 (c)(1), (2), (4) Date: Apr. 2, 2007

(87) PCT Pub. No.: WO2006/041516

PCT Pub. Date: Apr. 20, 2006

(65) Prior Publication Data

US 2007/0270025 A1 Nov. 22, 2007

Related U.S. Application Data

(60) Provisional application No. 60/616,994, filed on Oct. 8, 2004.

(51) Int. Cl.
*H01R 13/72* (2006.01)

(52) U.S. Cl. ..... 439/501

(58) Field of Classification Search ..... 439/211, 439/501, 502, 209, 212, 214, 135; 174/97, 174/53

See application file for complete search history.

(56) References Cited

U.S. PATENT DOCUMENTS

| | | | | |
|---|---|---|---|---|
| 4,017,137 | A | 4/1977 | Parks | |
| 4,872,849 | A * | 10/1989 | Long | 439/209 |
| 5,024,614 | A * | 6/1991 | Dola et al. | 439/114 |
| 5,595,494 | A | 1/1997 | Wiebe | |
| D404,010 | S | 1/1999 | Viklund et al. | |
| 5,886,295 | A * | 3/1999 | Carino et al. | 174/481 |
| 6,083,015 | A * | 7/2000 | Vargas et al. | 439/130 |
| 6,364,678 | B1 * | 4/2002 | Hellwig et al. | 439/211 |
| D467,552 | S | 12/2002 | Mori et al. | |
| D467,877 | S | 12/2002 | Mori et al. | |

OTHER PUBLICATIONS

Search Report Dated Jul. 12, 2005.

* cited by examiner

*Primary Examiner*—Chandrika Prasad
(74) *Attorney, Agent, or Firm*—Robert D. Shedd; Robert B. Levy; Jeffrey D. Hale

(57) ABSTRACT

A cord management device includes a first end (13); a second end (13); and an intermediate portion (12) between the first (13) and the second (13) ends. The first (13) and the second (13) ends include mating details for engaging with a socket device (5) and forming a closed loop (14) between the intermediate portion (12) and the socket device (5).

20 Claims, 3 Drawing Sheets

POWER CORD MANAGEMENT ATTACHMENT FOR USE WITH A POWER SOCKET DEVICE

This application claims the benefit, under 35 U.S.C. § 365 of International Application PCT/US2005/007490, filed Mar. 8, 2005, which was published in accordance with PCT Article 21(2) on Apr. 20, 2006 in English and which claims the benefit of U.S. provisional patent application No. 60/616,994, filed Oct. 8, 2004.

FIELD OF THE INVENTION

The present invention relates generally to power outlet devices, and more particularly to a device for managing multiple power cords plugged to a multiplying outlet device.

BACKGROUND OF THE INVENTION

Cord management features can be found on many surge suppressors or other molded socket multiplying devices on the market today. Some of these cord management implementations are integral or formed as part of the outlet multiplying device case itself. In other examples, a separate article that works in conjunction with a surge suppressor or socket multiplying device performs the cord or cable management. Molded or formed as part of the device solutions have the advantage that they are more cost effective since they are already a part of the case of a socket multiplying device. The disadvantage is that they require the product to be longer or larger to accommodate this feature, which can make the size of the overall socket multiplying device with cord management impractical.

The units that use a separate article for cord management overcome this impractical size shortcoming by folding or telescoping back into the unit they attach to and occupy less space than the molded in variations. In either configuration, such solutions require feeding cords into the management device one at a time. Feeding cords one at a time can be an arduous process that makes managing the cords unpleasant enough that the user may not even wish to use this feature. Feeding one cord at a time is a solution that operates basically on an open cavity principal that has the potential to release cords from its grasp. From a manufacturing point of view, it is not possible to remove an integral or molded in cord management feature if it needs to be eliminated for some socket multiplying device models. If a surge suppressor or socket-multiplying device is designed with cord/cable management it will always have it. This reduces the product's flexibility for both the manufacturer and the user.

Accordingly, there is a need for a removable cord management device that is of a practical size and can accommodate managing multiple cords simultaneously.

SUMMARY OF THE INVENTION

The inventive cord management device works with the design configuration of a surge suppressor or socket multiplying device to manage the arrangement of cords that are plugged into that surge suppressor or socket multiplying device.

A cord management device includes a first end, a second end and an intermediate portion between the first and second ends. The first and second ends include mating details for engaging with a socket device and forming a closed loop 14 between the intermediate portion and the socket device.

A method for cord management includes attaching a first end of a cord management device to a first mating detail of a socket device, attaching a second end of the cord management device to a second mating detail of the socket device, and forming a closed loop bounded by a portion of the cord management device and the socket device when the first and second ends of the cord management device are attached to the first and second mating details of the socket device.

A cord management system includes a socket device having first and second mating details and a cord management device. The cord management device includes a first end, a second end, and an intermediate portion between the first and second ends. The intermediate portion forming a closed loop between the cord management device and the socket device when the first and second ends are cooperatively engaged with the first and second mating details of the socket device.

BRIEF DESCRIPTION OF THE DRAWINGS

A more complete understanding of the present invention may be obtained from consideration of the following description in conjunction with the drawings, in which.

To facilitate understanding, identical reference numerals have been used, where possible, to designate identical elements that are common to the figures.

DETAILED DESCRIPTION

Figure 1:
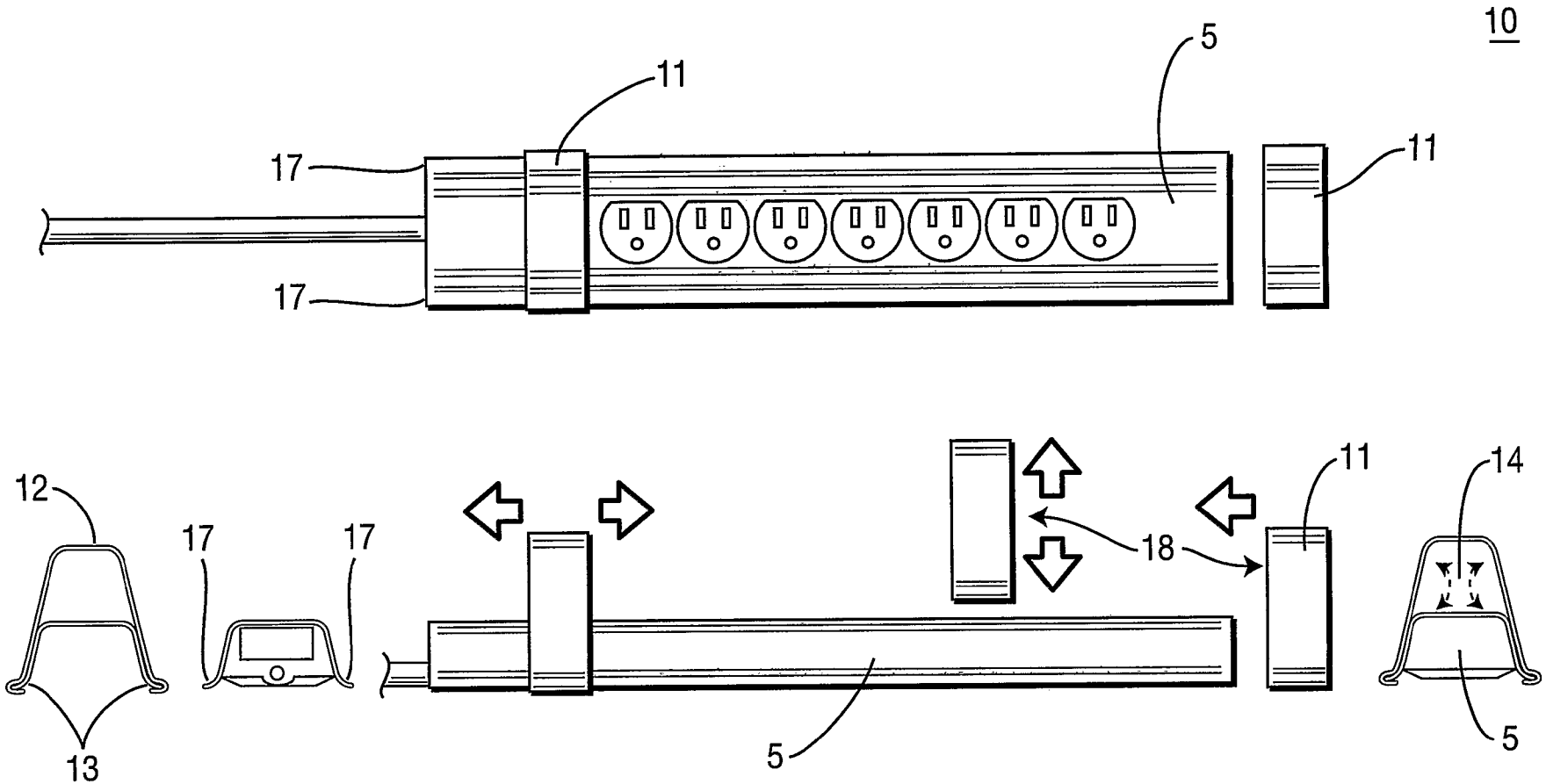
FIG. 1 is a combination of views showing details of an inventive cord management device.
Figure 2:
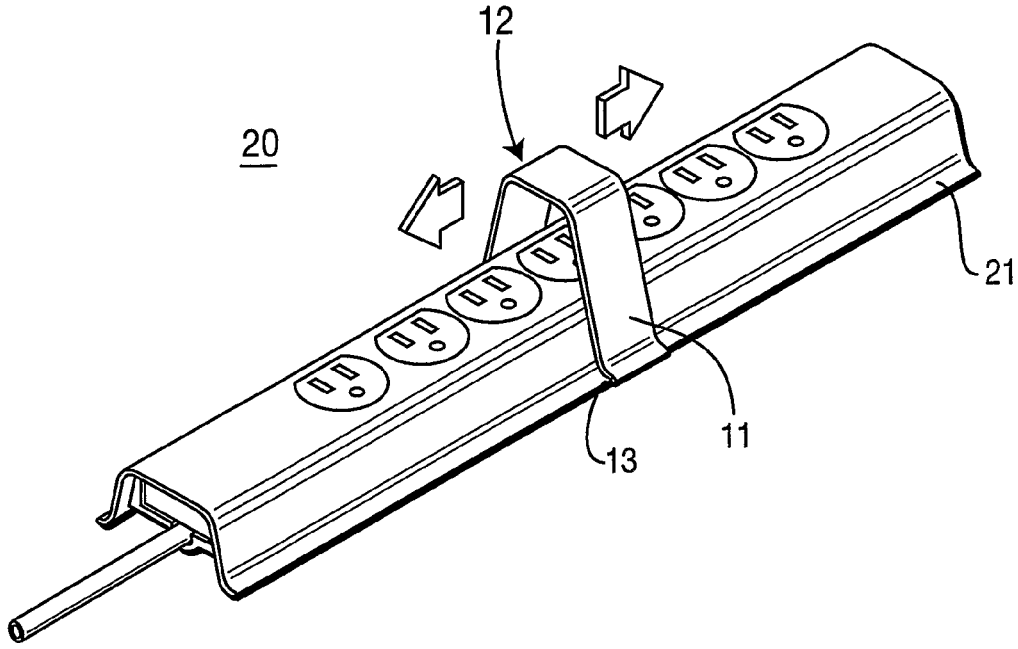
FIG. 2 is a perspective view of the cord management device of FIG. 1 secured to a socket multiplying device.

The inventive cord management device redirects and groups cords or cables that are plugged into a surge suppressor or other socket-multiplying device to unify their direction and eliminate clutter and confusion. Unifying the direction of the cords or cables is done in a manner that is easy and intuitive and in a way that will not accidentally release cords or cables. The inventive cord management device also compacts the overall space that would normally be occupied by known cord management devices. The cord management device can be removed at any time without need to unplug the cords or consequence to the design of the surge suppressor or socket-multiplying device Referring now to a combination of orthogonal views 10 in FIG. 1, and perspective views 20 and 30 in FIGS. 2 and 3, respectively, an inventive cord management device 11 is shown unsecured and secured to a socket multiplying device 5. The cord management device includes attachment or mating ends 13 for securing to a socket multiplying device 5 in a sliding manner and a top part 12 forming a closed loop when the cord management device 11 is secured to a socket multiplying device. Preferably, the surge suppressor or socket-multiplying device 5 has two parallel sides that preferably run along the length of the device seen from view direction 17. These sides also preferably contain a symmetrical detail such as a rib 21, a number of ribs, or any other feature that allows the cord management device 11 to attach to the surge suppressor or socket-multiplying device 5. This rib 21 allows the cord management device 11 to slide along these ribs or other details along the length of the socket multiplying device as shown by direction 17 in FIG. 1. The rib 21 is preferably also part of the surge suppressor or socket multiplying device's design without the cord management device 11 attached. In other words, if the surge suppressor or socket multiplying device is without the cord management device it can still appear to be a complete product. A single rib 21 is shown in the Figures as it allows for easy mold ability and aesthetic integration.

Figure 3:
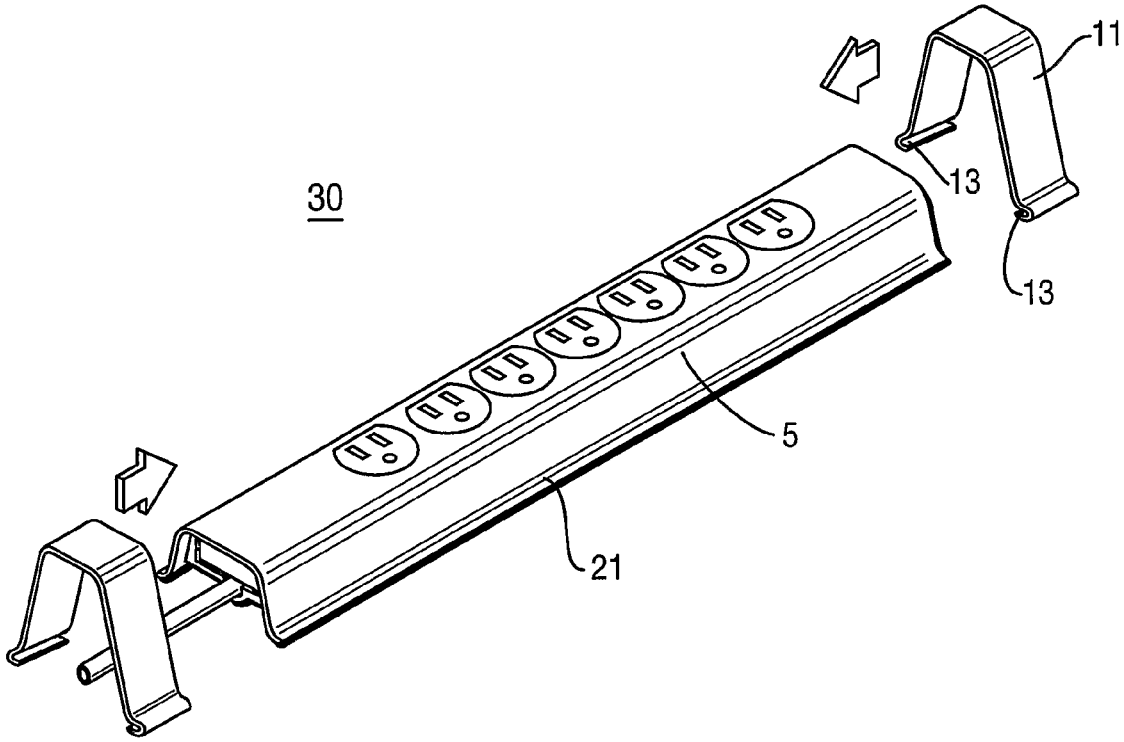
FIG. 3 is a perspective view of the inventive cord management device to be secured to a socket multiplying device.

Preferably, the cord management device 11 is detachable and has a mating detail 13 that cooperates with the rib detail 21 of the socket multiplying device 5. As shown in FIG. 3. the mating detail 13 can be configured as a hook surface. This mating of details 13, 21 can allow the allow the cord management device 11 to be slide along the length of the surge suppressor or socket-multiplying device 5 using the top surface of the surge suppressor or socket-multiplying device 5 to form a closed loop 14. The mating details 13, 21 can also allow for the cord management device to be snapped on or off at any point along the length of the surge suppressor or socket multiplying device 5 as shown by directional view 18. The inventive cord management device 11 functions with a cooperating socket multiplying device 5 to provide a cord management system operable in a sliding manner or a "snap on, snap off" manner.

Figure 4:
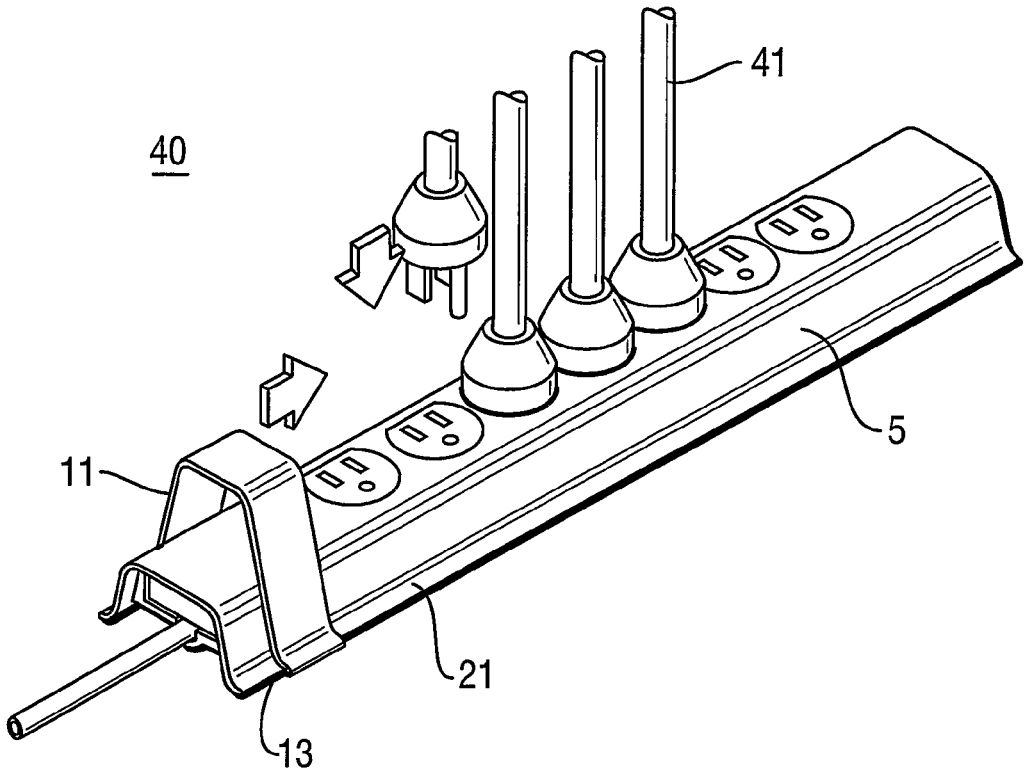
FIG. 4 is a perspective view of the inventive cord management device being initially fastened to the socket multiplying device with multiple cords attached.
Figure 5:
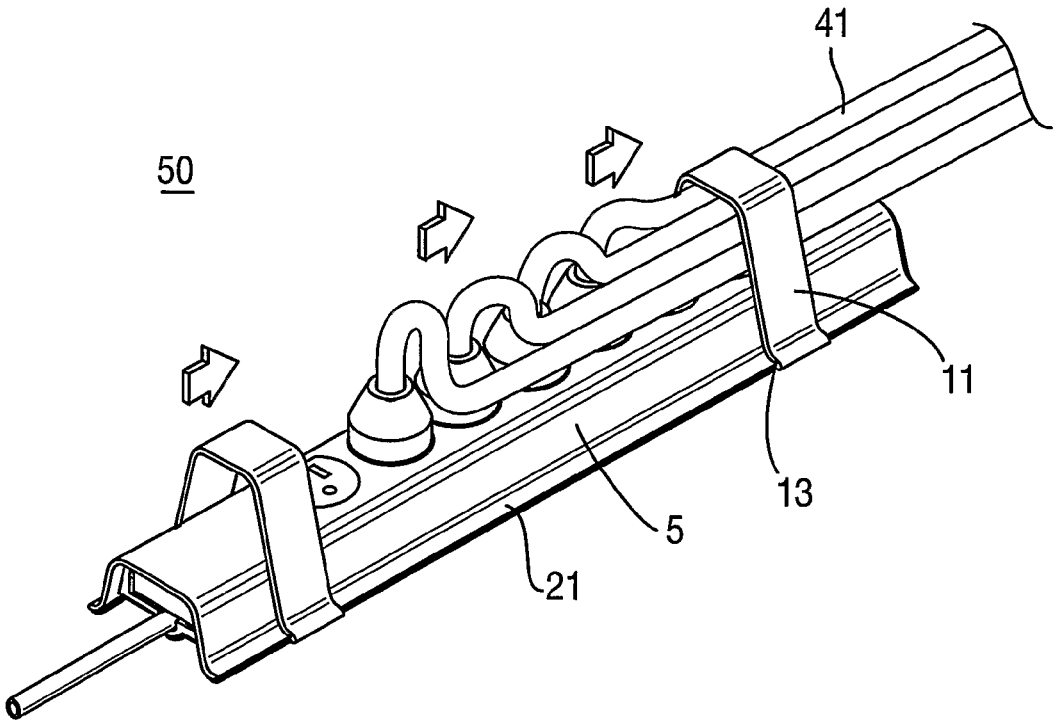
FIG. 5 is a perspective view showing the inventive cord management device fastened to a socket multiplying device to arrange multiple cords.

Use of the inventive cord management device in a sliding manner near one end of the surge suppressor or socket multiplying device 5, as shown by perspective views 30, 40 and 50 in FIGS. 3, 4 and 5, respectively. Cord plugs from desired peripherals are inserted into the open sockets of the socket multiplying device in a typical manner. Once cord plugs are inserted, the attachment ends 13 of the cord management device 11 are engaged with the rib detail 21 of the socket multiplying device 5. The cord management device 11 is moved in a sliding manner down the length of the surge suppressor or socket multiplying device 5 to combine the cord lengths 41 in one unified direction as shown in FIG. 5. The cord lengths 41 are now managed into one direction eliminating cord sprawl and clutter. For individual cord 41 replacement or removal the cord management device 11 can be moved in a sliding manner in the opposite direction freeing the cords 41 as needed.

Use of the inventive cord management device 11 in a snap on, snap off manner begins with the cord management device 11 removed from the surge suppressor or socket-multiplying device 5. The cord management device 11 may be removed by sliding it off either end of the surge suppressor or socket-multiplying device 5 or by snapping it off the ribs details 21 of the socket multiplying device 21. The desired cord plugs 41 are inserted into the socket multiplying device 21 in a normal manner. For individual cord 41 replacement or removal the user can simply snap off the cord management device 11 from the rib details 21 of the surge suppressor or socket multiplying device 5 to free the cords 41 as needed.

Although various embodiments which incorporate the teachings of the present invention have been shown and described in detail, those skilled in the art can readily devise many other varied embodiments that will still incorporate these teachings.

The invention claimed is:

1. A power cord management device for external attachment to a power socket device, the power cord management device comprising:

a first end;

a second end; and an intermediate portion between said first and second ends, wherein said first and second ends include mating details for attaching to external mating features of a housing unit of the power socket device to form a closed loop between the intermediate portion and an external surface of the housing unit, the external surface configured to receive power plugs from a side of the housing unit on which the closed loop is disposed, wherein the closed loop retains one or more external power cords that pass through the closed loop external to the housing unit of the power socket device and wherein said first end, when attached to said external mating features, includes a hook surface that engages with said external mating features to prevent movement of said intermediate portion in an outward, perpendicular direction from said side of the housing unit.

2. The cord management device of claim 1, wherein said mating details of said first and second ends cooperate with said external mating features of said housing unit of said power socket device in a horizontal sliding manner along a length of the housing unit.

3. The cord management device of claim 1, wherein said power cord management device is removable from said power socket device.

4. The cord management device of claim 1, wherein said mating details of said first and second ends cooperate with said external mating features of said housing unit of said power socket device in at least one of a sliding manner or a snap on and snap off manner.

5. The device of claim 1, wherein said intermediate portion positions said first and second ends to be in one of sliding engagement and snap on, snap off engagement with said external mating features of said housing unit of said power socket device.

6. The device of claim 1, wherein said mating details are partially looped to cooperate with said external mating features of said housing unit of said power socket device.

7. The device of claim 1, wherein said first and second ends include mating details for engaging with said external mating features of said housing unit of said power socket device having multiple outlets and forming a closed loop between said intermediate portion and said external surface of said housing unit of said power socket device for unifying direction of cords inserted into said socket device.

8. The device of claim 1, wherein said first and second ends include mating details for engaging in a sliding manner with said external mating features of said housing unit of said power socket device having multiple outlets and forming a closed loop between said intermediate portion and said external surface of said housing unit of said power socket device for unifying direction of cords inserted into said multiple outlets.

9. The device of claim 1, wherein said first and second ends include mating details for engaging in a snap on and snap off manner with said external mating features of said housing unit of said power socket device having multiple outlets and forming a closed loop between said intermediate portion and said external surface of said housing unit of said power socket device for unifying direction of cords inserted into said multiple outlets.

10. A method for power cord management comprising the steps of:

attaching a first end of a power cord management device to a first external mating detail of a housing unit of a power socket device;

attaching a second end of said power cord management device to a second external mating detail of said housing unit of said power socket device; and forming a closed loop bounded by a portion of said power cord management device and an external surface of said housing unit of said power socket device when said first and second ends of said power cord management device are attached to said first and second external mating details of said housing unit of said power socket device, the external surface being configured to receive power plugs from a side of the housing unit on which the closed loop is disposed, wherein said first end, when attached to said first external mating detail, includes a hook surface that engages with said first external mating detail to prevent movement of said power cord management device in an outward, perpendicular direction from said side of the housing unit;

utilizing the closed loop to retain at least one cord that passes through the loop.

11. The method of claim 10, wherein said steps of attaching said first and second ends to said first and second external mating details of said housing unit are in a horizontal sliding manner along a length of the housing unit.

12. The method of claim 10, wherein said power cord management device is removable from said power socket device.

13. The method of claim 10, wherein said steps of attaching said first and second ends to said first and second external mating details of said housing unit are in at least one of a sliding manner or a snap on and snap off manner.

14. The method of claim 10, wherein said steps of attaching are in a sliding manner for unifying direction of cords inserted into said power socket device with said closed loop.

15. The method of claim 10, wherein said steps of attaching are in a snap on and snap off manner for unifying direction of cords inserted into said power socket device with said closed loop.

16. The method of claim 10, wherein said steps of attaching are in both a sliding manner and a snap on and snap off manner for unifying direction of cords inserted into said power socket device with said closed loop.

17. A power cord management system comprising:

a power socket device having a housing unit with first and second external mating details; and a power cord management device for external attachment to the housing unit of the power socket device, the power cord management device including:

a first end;

a second end; and an intermediate portion between said first and second ends, said intermediate portion forming a closed loop between said power cord management device and an external surface of said housing unit of said power socket device when said first and second ends are cooperatively attached to said first and second external mating details of said housing unit of said power socket device, the intermediate portion retaining at least one power cord that passes through the closed loop external to the housing unit of the power socket device, wherein the external surface is configured to receive power plugs from a side of the housing unit on which the closed loop is disposed and wherein said first end includes a hook surface that engages with said first external mating detail to prevent movement of said intermediate portion in an outward, perpendicular direction from said side of the housing unit.

18. The power cord management system of claim 17, wherein said first and second ends are cooperatively engaged with said first and second external mating details of said housing unit of said power socket device in a horizontal sliding manner along a length of said housing unit.

19. The power cord management system of claim 17, wherein said power cord management device is removable from said power socket device.

20. The power cord management system of claim 17, wherein said first and second ends are cooperatively engaged with said first and second external mating details of said housing unit of said power socket device in at least one of a sliding manner or a snap on and snap off manner.

* * * * *